US012055021B2

(12) United States Patent
Ejim et al.

(10) Patent No.: US 12,055,021 B2
(45) Date of Patent: Aug. 6, 2024

(54) SAND SHIELD FOR PROTECTING INVERTED ELECTRIC SUBMERSIBLE PUMP AT SHUTDOWN

(71) Applicant: SAUDI ARABIAN OIL COMPANY, Dhahran (SA)

(72) Inventors: Chidirim Enoch Ejim, Dhahran (SA); Jinjiang Xiao, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 133 days.

(21) Appl. No.: 17/955,457

(22) Filed: Sep. 28, 2022

(65) Prior Publication Data

US 2024/0102367 A1 Mar. 28, 2024

(51) Int. Cl.
*E21B 43/12* (2006.01)
*F04D 13/08* (2006.01)
*F04D 29/70* (2006.01)

(52) U.S. Cl.
CPC ..... *E21B 43/128* (2013.01); *F04D 13/086* (2013.01); *F04D 29/708* (2013.01)

(58) Field of Classification Search
CPC ..... E21B 43/128; C09K 8/58
USPC ..... 166/266
See application file for complete search history.

(56) References Cited

U.S. PATENT DOCUMENTS 7,051,815 B2 * 5/2006 Ireland ..... F04C 13/008 166/105.1
7,325,606 B1 * 2/2008 Vail, III ..... E21B 43/128 166/250.15
9,181,785 B2 * 11/2015 Lawson ..... E21B 43/128
10,947,813 B2 3/2021 Ejim et al.
11,187,250 B2 11/2021 Gou et al.
(Continued)

FOREIGN PATENT DOCUMENTS

CA 2607683 A1 4/2008
GB 2411416 A 8/2005
(Continued)

OTHER PUBLICATIONS

International Search Report and Written Opinion for PCT Application No. PCT/US2023/074443 dated Dec. 22, 2023.

*Primary Examiner* — William D Hutton, Jr.
*Assistant Examiner* — Ashish K Varma
(74) *Attorney, Agent, or Firm* — Bracewell LLP; Constance G. Rhebergen; Keith R. Derrington

(57) ABSTRACT

Systems and methods for providing artificial lift to wellbore fluids includes a pump, a motor, and a protector assembly forming an electric submersible pump system located in a wellbore. A solids isolator is located between the pump and the protector assembly. The solids isolator includes a tubular discharge body with an inner discharge bore. A body port extends through a sidewall of the discharge body. A sliding seal member is located within the discharge bore and moveable between a port open position where the body port is open to allow fluids to travel through the body port, and a port closed position, where fluids are prevented from traveling through the body port. The sliding seal member is ring shaped in cross section. The sliding seal member is biased to the port closed position when the pump is off and moveable to the port open position when the pump is on.

20 Claims, 10 Drawing Sheets

(56) References Cited

U.S. PATENT DOCUMENTS

| | | | | |
|---|---|---|---|---|
| 2019/0003296 | A1* | 1/2019 | Fielder, III | E21B 43/35 |
| 2022/0025738 | A1 | 1/2022 | Nowitzki et al. | |

FOREIGN PATENT DOCUMENTS

| | | | |
|---|---|---|---|
| GB | 2549751 | A | 11/2017 |
| WO | 2020028355 | A1 | 2/2020 |

* cited by examiner

SAND SHIELD FOR PROTECTING INVERTED ELECTRIC SUBMERSIBLE PUMP AT SHUTDOWN

BACKGROUND OF THE DISCLOSURE

1. Field of the Disclosure

The present disclosure relates to electric submersible pumps used in hydrocarbon development operations, and more specifically, the disclosure relates to an inverted electric submersible pump completion with a sand shield.

2. Description of the Related Art

In hydrocarbon developments, it is common practice to use electric submersible pumping systems (ESPs) as a primary form of artificial lift. As an example tubing-deployed inverted ESPs installed between an uphole packer and downhole packer, or through-tubing cable deployed ESP systems which sting into a polished bore receptacle can be used to provide artificial lift. During pump shutdown, sand and other solids in the wellbore can travel in a downhole direction due to the reduction in pressure. Sand and other solids can enter the pump discharge and fall back through the pump section of the inverted ESP.

SUMMARY OF THE DISCLOSURE

Sand falling back through the pump section of the inverted ESP system is detrimental to the operation of an ESP system over repeated periods of shutdown during production. Systems and methods of this disclosure prevent sand and other solids that are traveling downhole from entering the discharge of the pump section of an inverted ESP system when the pump is shut down.

When the pump is shut down, an operator may deliver fluids from the surface to a location downhole of the ESP system. Such fluids have the potential to be detrimental to certain pump components. Embodiments of this disclosure also prevent fluids that are purposefully pumped downhole from entering the discharge of the pump section and traveling through the pump section of the ESP system.

In an embodiment of this disclosure, a system for providing artificial lift to wellbore fluids includes a pump located within a wellbore. The pump is oriented to selectively boost a pressure of the wellbore fluids traveling from the wellbore towards an earth's surface through a production tubular. A motor is located within the wellbore uphole of the pump and providing power to the pump. A protector assembly is located between the pump and the motor. The pump, the motor, and the protector assembly form an electric submersible pump system. A downhole packer is located within the wellbore downhole of the pump. The downhole packer seals an annular space between an outer diameter surface of the electric submersible pump system and an inner diameter of the wellbore. A solids isolator is located between the pump and the protector assembly. The solids isolator includes a tubular discharge body with an inner discharge bore having a central axis. A body port extends through a sidewall of the discharge body. A sliding seal member is located within the discharge bore. The sliding seal member is moveable between a port open position where the body port is open to allow fluids to travel through the body port between the discharge bore and an outside of the electric submersible pump system, and a port closed position where fluids are prevented from traveling through the body port between the discharge bore and the outside of the electric submersible pump system. The sliding seal member is ring shaped in cross section. The sliding seal member is biased to the port closed position when the pump is off and the sliding seal member is moveable to the port open position when the pump is on.

In alternate embodiments, the system can further include a biasing member, the biasing member positioned to bias the sliding seal member towards the port closed position. The sliding seal member can further include a counter pressure member. The counter pressure member is oriented so that when the pump is on, a force on the counter pressure member overrides a force of the biasing member, moving the sliding seal member towards the port open position.

In other alternate embodiments, the system can include a sand diverter located downhole of the pump and having a flow port assembly located uphole of the downhole packer. The sand diverter can have a diverter inner bore in fluid communication with the wellbore downhole of the downhole packer. The flow port assembly can have an inner sleeve that is moveable between an open position where an inner sleeve port assembly is aligned with an outer sleeve port assembly of an outer sleeve, and a closed position where the inner sleeve port assembly is misaligned with the outer sleeve port assembly.

In yet other alternate embodiments, the tubular discharge body can have a housing head that has a tubular lip that extends axially within the discharge bore. The solids isolator can further include an inner seal that seals between an outer diameter surface of the tubular lip of the housing head and an inner diameter surface of the sliding seal member. An outer seal can seal between an outer diameter surface of the sliding seal member and an inner diameter surface of the discharge bore.

In still other alternate embodiments, the system can further include a shaft extending between the motor and the pump, the shaft extending along the central axis of the discharge body. The solids isolator can further include a downhole bearing supporting the shaft within the discharge bore of the discharge body downhole of the sliding seal member, and an uphole bearing supporting the shaft within the discharge bore of the discharge body uphole of the sliding seal member. The discharge body can alternately further include an uphole end that has an end cap. The end cap can circumscribe the shaft and sealing across the discharge bore. An uphole rotary seal can seal between the shaft and a central opening of the end cap. The discharge body can have a downhole end that is open.

In other alternate embodiments, the discharge body can include a plurality of the body ports and the sliding seal member can include a plurality of inner ports. When the sliding seal member is in the port open position, the body ports can be aligned with the inner ports. Alternately, the sliding seal member can include a traveling ring. The traveling ring can be located downhole of the body port when the sliding seal member is in the port closed position. The traveling ring can be located uphole of the body port when the sliding seal member is in the port open position. The solids isolator can further include a check valve. The check valve can be oriented to allow fluids to travel from the discharge bore to the outside of the electric submersible pump system, and to prevent fluids from traveling from the outside of the electric submersible pump system to inside the discharge bore. The check valve can be located uphole of the traveling ring.

In other embodiments of this disclosure, a method for providing artificial lift to wellbore fluids includes locating a pump within a wellbore. The pump is operable to selectively boost a pressure of the wellbore fluids traveling from the wellbore towards an earth's surface through a production tubular. A motor is located within the wellbore uphole of the pump. The motor provides power to the pump. A protector assembly is located between the pump and the motor. The pump, the motor, and the protector assembly form an electric submersible pump system. A downhole packer is located within the wellbore downhole of the pump. The downhole packer seals an annular space between an outer diameter surface of the electric submersible pump system and an inner diameter of the wellbore. A solids isolator is located between the pump and the protector assembly. The solids isolator includes a tubular discharge body with an inner discharge bore having a central axis. A body port extends through a sidewall of the discharge body. A sliding seal member is located within the discharge bore. The sliding seal member is moveable between a port open position where the body port is open to allow fluids to travel through the body port between the discharge bore and an outside of the electric submersible pump system, and a port closed position where fluids are prevented from traveling through the body port between the discharge bore and the outside of the electric submersible pump system. The sliding seal member is ring shaped in cross section. The sliding seal member moves to the port closed position when the pump is off. The sliding seal member moves to the port open position when the pump is on.

In alternate embodiments, a biasing member can be positioned to bias the sliding seal member towards the port closed position. The sliding seal member can further include a counter pressure member and the method can further include moving the sliding seal member towards the port open position when the pump is on with a fluid force applied to the counter pressure member that overrides the force of the biasing member. A sand diverter can be located downhole of the pump and having a flow port assembly located uphole of the downhole packer. The sand diverter can have a diverter inner bore in fluid communication with the wellbore downhole of the downhole packer. The method can further include moving an inner sleeve of the flow port assembly between an open position where an inner sleeve port assembly is aligned with an outer sleeve port assembly of an outer sleeve, and a closed position where the inner sleeve port assembly is misaligned with the outer sleeve port assembly.

In other alternate embodiments, the tubular discharge body can have a housing head that has a tubular lip that extends axially within the discharge bore. The method can further include sealing between an outer diameter surface of the tubular lip of the housing head and an inner diameter surface of the sliding seal member with an inner seal, and sealing between an outer diameter surface of the sliding seal member and an inner diameter surface of the discharge bore with an outer seal.

In yet other alternate embodiments, a shaft can extend between the motor and the pump, the shaft extending along the central axis of the discharge body. The method can further include supporting the shaft within the discharge bore of the discharge body downhole of the sliding seal member with a downhole bearing, and supporting the shaft within the discharge bore of the discharge body uphole of the sliding seal member with an uphole bearing. The discharge body can further include an uphole end that has an end cap, the end cap circumscribing the shaft and sealing across the discharge bore and an uphole rotary seal that seals between the shaft and a central opening of the end cap. The discharge body can have a downhole end that is open.

In still other alternate embodiments, the discharge body can include a plurality of the body ports and the sliding seal member can include a plurality of inner ports. The method can further include aligning the inner ports with the body ports when the sliding seal member is in the port open position. Alternately, the sliding seal member can include a traveling ring and the method can further include positioning the traveling ring downhole of the body port when the sliding seal member is in the port closed position, and positioning the traveling ring uphole of the body port when the sliding seal member is in the port open position. A check valve can be located uphole of the traveling ring. The check valve can be oriented to allow fluids to travel from the discharge bore to the outside of the electric submersible pump system, and to prevent fluids from traveling from the outside of the electric submersible pump system to inside the discharge bore.

BRIEF DESCRIPTION OF THE DRAWINGS

So that the manner in which the features, aspects and advantages of the embodiments of this disclosure, as well as others that will become apparent, are attained and can be understood in detail, a more particular description of the disclosure may be had by reference to the embodiments that are illustrated in the drawings that form a part of this specification. It is to be noted, however, that the appended drawings illustrate only certain embodiments of the disclosure and are, therefore, not to be considered limiting of the disclosure's scope, for the disclosure may admit to other equally effective embodiments.

FIG. 1 is a section view of a subterranean well with an electric submersible pump system and a solids isolator in accordance with an embodiment of this disclosure, shown with a pump of the electric submersible pump system on.

FIG. 4 is a section view of a subterranean well with an electric submersible pump system and a solids isolator in accordance with an embodiment of this disclosure, shown with a pump of the electric submersible pump system on.

DETAILED DESCRIPTION

The disclosure refers to particular features, including process or method steps. Those of skill in the art understand that the disclosure is not limited to or by the description of embodiments given in the specification. The subject matter of this disclosure is not restricted except only in the spirit of the specification and appended Claims.

Those of skill in the art also understand that the terminology used for describing particular embodiments does not limit the scope or breadth of the embodiments of the disclosure. In interpreting the specification and appended Claims, all terms should be interpreted in the broadest possible manner consistent with the context of each term. All technical and scientific terms used in the specification and appended Claims have the same meaning as commonly understood by one of ordinary skill in the art to which this disclosure belongs unless defined otherwise.

As used in the Specification and appended Claims, the singular forms "a," "an," and "the" include plural references unless the context clearly indicates otherwise.

As used, the words "comprise," "has," "includes," and all other grammatical variations are each intended to have an open, non-limiting meaning that does not exclude additional elements, components or steps. Embodiments of the present disclosure may suitably "comprise," "consist," or "consist essentially of" the limiting features disclosed, and may be practiced in the absence of a limiting feature not disclosed. For example, it can be recognized by those skilled in the art that certain steps can be combined into a single step.

Where a range of values is provided in the Specification or in the appended Claims, it is understood that the interval encompasses each intervening value between the upper limit and the lower limit as well as the upper limit and the lower limit. The disclosure encompasses and bounds smaller ranges of the interval subject to any specific exclusion provided.

Where reference is made in the specification and appended Claims to a method comprising two or more defined steps, the defined steps can be carried out in any order or simultaneously except where the context excludes that possibility.

Figure 1:
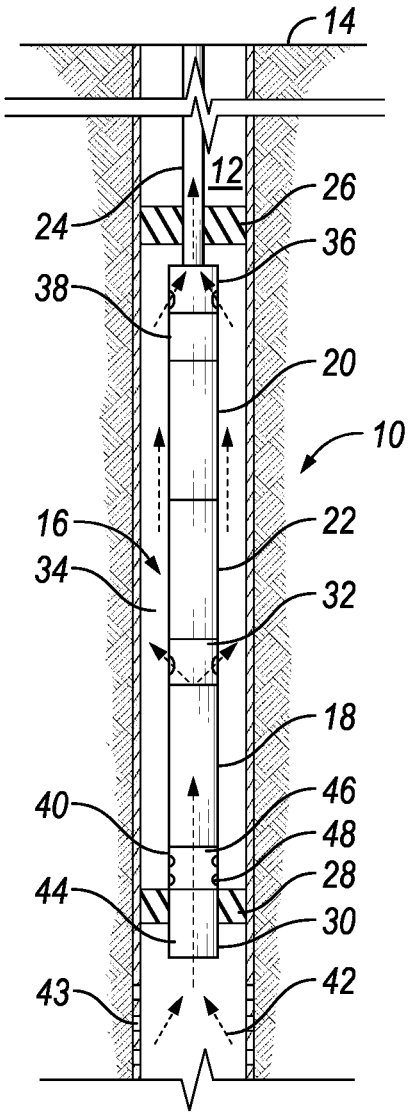

Looking at FIG. 1, subterranean well 10 can have wellbore 12 that extends to an earth's surface 14. Subterranean well 10 can be an offshore well or a land based well and can be used for producing fluids, such as producing hydrocarbons from subterranean hydrocarbon reservoirs. Submersible pump string 16 can be located within wellbore 12. Submersible pump string 16 can provide artificial lift to wellbore fluids. Submersible pump string 16 can include an electric submersible pump system (ESP) that has pump 18, motor 20, and protector assembly 22.

Pump 18 can be, for example, a rotary pump such as a centrifugal pump. Pump 18 could alternatively be a progressing cavity pump, which has a helical rotor that rotates within an elastomeric stator or other type of pump known in the art for use with an electric submersible pump assembly. Pump 18 can consist of stages, which are made up of impellers and diffusers. The impeller, which is rotating, adds energy to the fluid to provide head and the diffuser, which is stationary, converts the kinetic energy of fluid from the impeller into head. The pump stages can be stacked in series to form a multi-stage system that is contained within a pump housing. The sum of head generated by each individual stage is summative so that the total head developed by the multi-stage system increases linearly from the first to the last stage.

Pump 18 is located within wellbore 12 and is oriented to selectively boost the pressure of the wellbore fluids traveling from the wellbore towards the earth's surface 14 so that wellbore fluids can travel more efficiently to the earth's surface 14 through production tubular 24. Production tubular 24 extends within wellbore 12 to carry wellbore fluids from downhole to the earth's surface 14.

Motor 20 is also located within wellbore 12 and provides power to pump 18. Because embodiments of this disclosure provide for an inverted ESP, motor 20 is located uphole of pump 18. Protector assembly 22 is located between pump 18 and motor 20. Protector assembly 22 absorbs the thrust load from pump 18, transmits power from motor 20 to pump 18, equalizes pressure, receives additional motor oil as the temperature changes, and prevents wellbore fluid from entering motor 20.

Uphole packer 26 can be used to isolate the section of wellbore 12 that is uphole of uphole packer 26 from the section of wellbore 12 that contains submersible pump string 16. Uphole packer 26 can circumscribe production tubular 24 uphole of motor 20 and can seal around an inner diameter surface of wellbore 12. Uphole packer 26 can be, for example, an ESP feed-thru packer. In certain embodiments, such as the embodiments of FIGS. 4-7, there may be no uphole packer 26.

Downhole packer 28 can be located within wellbore 12 downhole of pump 18. Downhole packer 28 can be used to isolate the section of wellbore 12 that is downhole of downhole packer 28 from the section of wellbore 12 that contains submersible pump string 16. Downhole packer 28 can seal around the inner diameter surface of wellbore 12 and can circumscribe stinger 30. Downhole packer 28 can be, for example, a polished bore receptacle type of packer, allowing bypass stinger 30 to sting in so that stinger 30 extends through downhole packer 28.

Submersible pump string 16 can further include flow coupling 36 that is located uphole of motor 20. Flow coupling 36 can direct fluid from annular space 34 and into production tubular 24. In alternate embodiments, submersible pump string 16 could be cable deployed, such as in the embodiments of FIGS. 4-7. In such an embodiment, flow coupling 36 may not be included.

Submersible pump string 16 can further include monitoring sub 38. Monitoring sub 38 can monitor conditions within wellbore 12 as well as monitor the operation of submersible pump string 16. Monitoring sub 38 can measure and transmit data, including pump intake and discharge temperature and pressure, motor oil and winding temperature, and vibration.

Submersible pump string 16 can further include solids isolator 32 that is located between pump 18 and protector assembly 22. Solids isolator 32 can direct fluid out of pump 18 and into annular space 34 between an outer diameter surface of the electric submersible pump system and an inner diameter of wellbore 12.

In certain embodiments of this disclosure, submersible pump string 16 also includes sand diverter 40, which is located downhole of pump 18 and has flow port assembly 48 located uphole of downhole packer 28. Although sand diverter 40 is shown as a separate component, in alternate embodiments sand diverter 40 can be integrated with pump 18 or stinger 30. In still other embodiments, a sand diverter 40 may not be included.

In embodiments with sand diverter 40, sand diverter 40 can have a diverter inner bore in fluid communication with the wellbore downhole of the downhole packer. A flow port assembly of sand diverter 40 can have an inner sleeve that is moveable between an open position where an inner sleeve port assembly is aligned with an outer sleeve port assembly of an outer sleeve, and a closed position where the inner sleeve port assembly is misaligned with the outer sleeve port assembly.

In the embodiment of FIG. 1, pump 18 is on so that pump 18 is boosting the pressure of the wellbore fluids within wellbore 12 to assist the wellbore fluids in traveling in an uphole direction towards surface 14. As indicated by arrows 42, reservoir fluids will travel from perforations 43 downhole of downhole packer 28 and into stinger inner bore 44 of stinger 30 to pass by downhole packer 28. Reservoir fluids can include sand and other solids mixed in with the fluids.

Stinger 30 is downhole of sand diverter 40, and stinger inner bore 44 is in fluid communication with diverter inner bore 46 of sand diverter 40 so that wellbore fluids passing into stinger inner bore 44 passes into and through diverter inner bore 46 to reach pump 18. Diverter inner bore 46 of sand diverter 40 is in fluid communication with wellbore 12 downhole of downhole packer 28 by way of stinger inner bore 44.

After passing through pump 18, because pump 18 is on, solids isolator 32 directs the wellbore fluid out of pump 18 and into annular space 34. The wellbore fluid continues to travel in an uphole direction past protector assembly 22, motor 20, and monitoring sub 38 and then flow coupling 36 directs the wellbore fluid from annular space 34 into production tubular 24 to be produced to the surface and treated and processed using conventional methods.

Figure 2:
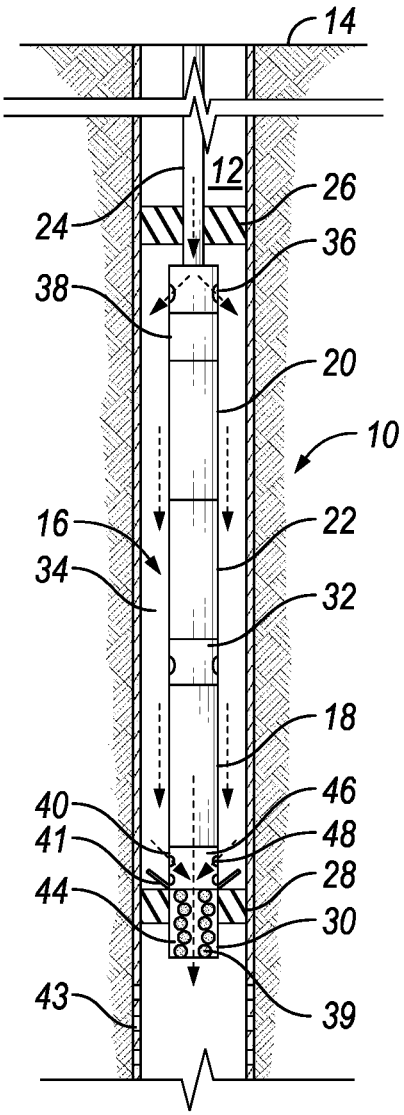
FIG. 2 is a section view of the subterranean well with the electric submersible pump system and a solids isolator in accordance with an embodiment of this disclosure, shown with the pump of the electric submersible pump system off and solids traveling downhole.

In the embodiment of FIG. 2, pump 18 is off, either intentionally or otherwise. With pump 18 off, the column of wellbore fluid within production tubular 24 moves in a direction downhole under the force of gravity. Wellbore fluid flowing downhole will pass through flow coupling 36 which will direct fluid out of production tubular 24 and into annular space 34. The wellbore fluid will pass by monitoring sub 38, motor 20, and protector assembly 22. As discussed herein in further detail, solids and fluids cannot enter solids isolator 32 and will remain within annular space 34 and continue to travel in a downhole direction towards downhole packer 28 and enter sand diverter 40 to be directed downhole of downhole packer 28.

In the embodiment of FIG. 2, sand skirt 41 is located uphole of downhole packer 28. Sand skirt 41 has a sloped inner diameter surface with an uphole end of sand skirt 41 having a larger inner diameter than the inner diameter of the downhole end of sand skirt 41. In this way, any solid particles 39 that drop towards downhole packer 28 can be directed radially inward by the sloped inner diameter surface of sand skirt 41. Sand skirt may be particularly useful in subterranean wells 10 where annular space 34 is sufficiently large that solid particles 39 could land on a radially outward part of downhole packer 28 and be outside of a flow path that could direct such solid particles towards sand diverter 40.

Figure 3:
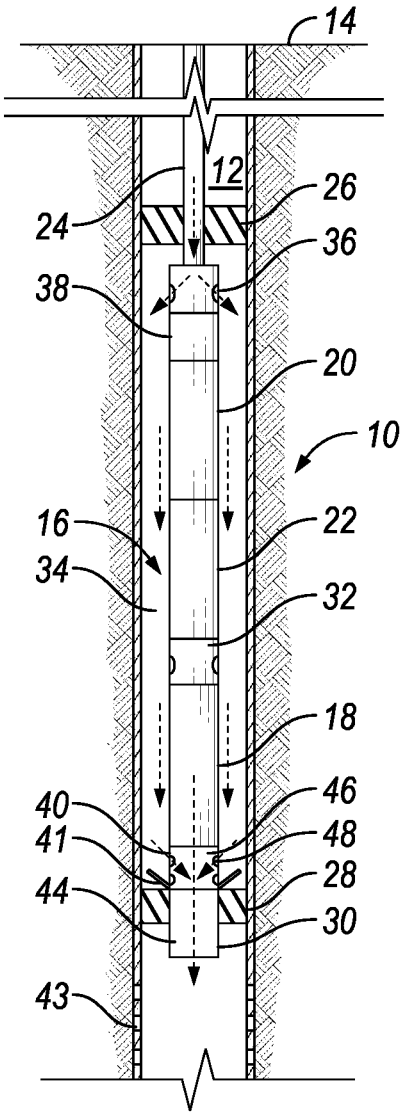
FIG. 3 is a section view of a subterranean well with an electric submersible pump system and a solids isolator in accordance with an embodiment of this disclosure, shown with a pump of the electric submersible pump system off and fluids being delivered from the surface to downhole of the electric submersible pump system.

In the embodiment of FIG. 3, there may be times when an operator delivers fluids from surface 14 to downhole of downhole packer 28. As an example, an operator may desire to deliver higher density liquids to the formation downhole of downhole packer by way of perforations 43. Such an operation can be known as a bullheading operation.

Fluids delivered as part of a bullheading operation may have suspended particles as part of the mixture component, which may be detrimental to the electrical submersible pump system. The bullheading operation may involve, for example, pumping liquid chemicals, such as acids, into the formation as a treatment to clean up the well of scales, or solids cake, or as a treatment of the reservoir to enhance stimulation and increase production. As shown in FIG. 3, the fluids delivered downhole will pass through flow coupling 36, which will direct fluid out of production tubular 24 and into annular space 34. The wellbore fluid will pass outside of monitoring sub 38, motor 20, and protector assembly 22.

As discussed herein in further detail, solids and fluids cannot enter solids isolator 32 and will remain within annular space 34 and continue to travel in a downhole direction towards downhole packer 28 and enter sand diverter 40 to be directed downhole of downhole packer 28. The bullheaded liquids will therefore bypass the inverted electric submersible pump system, thereby protecting the electric submersible pump system.

Figure 4:
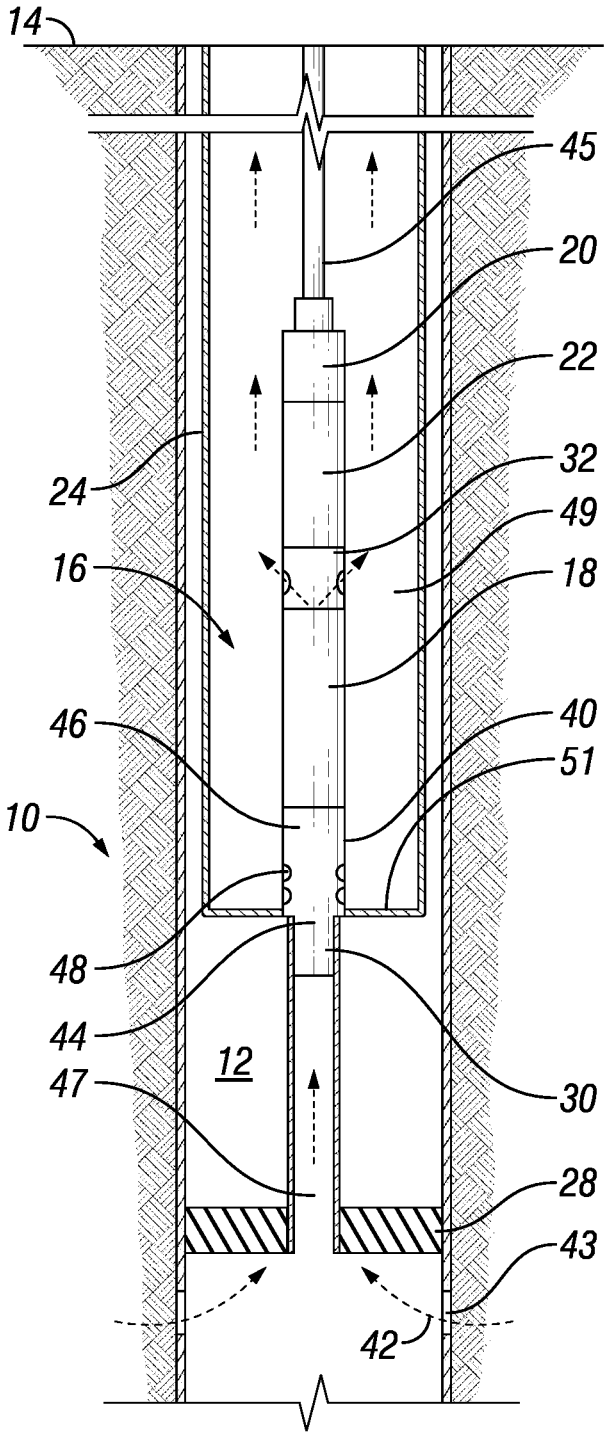

Looking at FIG. 4, in an alternate embodiment of the disclosure, submersible pump string 16 can be a through-tubing cable deployed ESP system. In such an embodiment, submersible pump string 16 is suspended within subterranean well 10 from surface 14 with cable 45 within production tubular 24. Downhole packer 28 can be located within wellbore 12 downhole of pump 18. Downhole packer 28 can seal around the inner diameter surface of wellbore 12 and can circumscribe polished bore receptacle 47. Stinger 30 can sting into polished bore receptacle 47 that extends through downhole packer 28.

Solids isolator 32 is located between pump 18 and protector assembly 22 and can direct fluid out of pump 18 and into annular space 49 between an outer diameter surface of the electric submersible pump system and an inner diameter of production tubular 24.

In the embodiment of FIG. 4, pump 18 is on so that pump 18 is boosting the pressure of the wellbore fluids within wellbore 12 to assist the wellbore fluids in traveling in an uphole direction towards surface 14. As indicated by arrows 42, reservoir fluids will travel from perforations 43 downhole of downhole packer 28 and into stinger inner bore 44 of stinger 30. Stinger inner bore 44 is in fluid communication with diverter inner bore 46 of sand diverter 40 so that wellbore fluids passing into stinger inner bore 44 passes into and through diverter inner bore 46 to reach pump 18. Diverter inner bore 46 of sand diverter 40 is in fluid communication with wellbore 12 downhole of downhole packer 28 by way of stinger inner bore 44.

After passing through pump 18, when pump 18 is on, solids isolator 32 directs the wellbore fluid out of pump 18 and into annular space 49. The wellbore fluid continues to travel in an uphole direction past protector assembly 22 and motor 20 to be produced to the surface through production tubular 24 and can be treated and processed using conventional methods.

Figure 5:
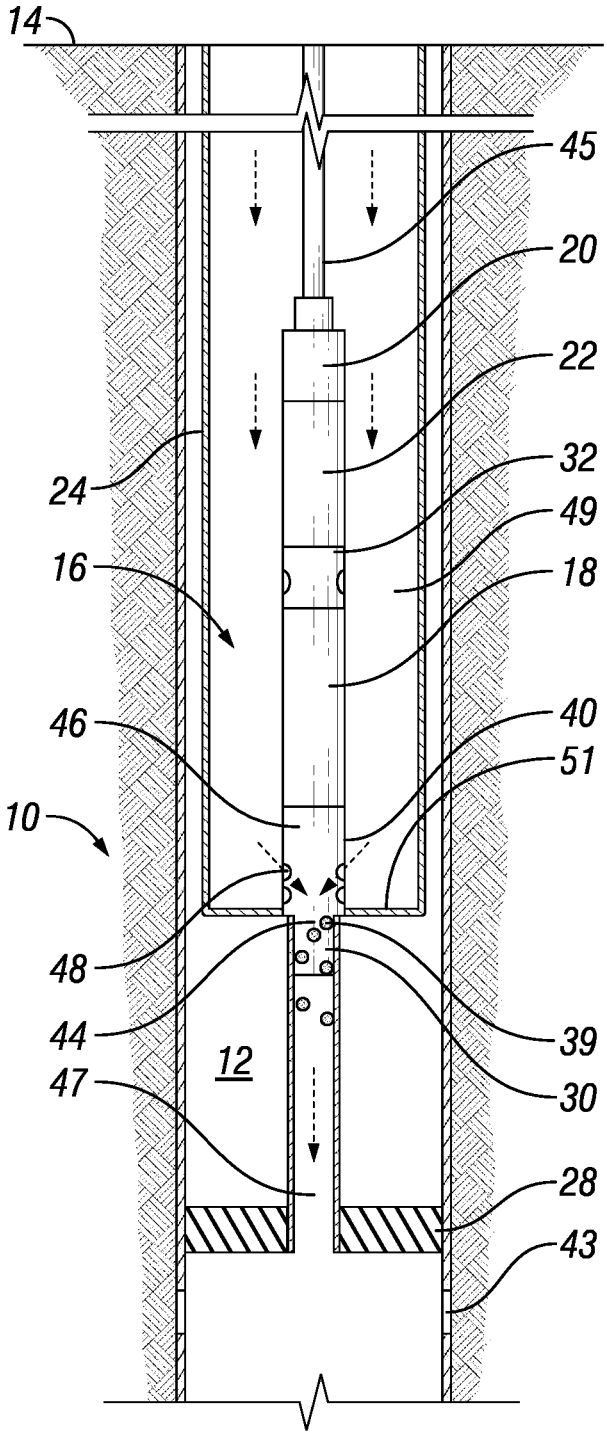
FIG. 5 is a section view of the subterranean well with the electric submersible pump system and a solids isolator in accordance with an embodiment of this disclosure, shown with the pump of the electric submersible pump system off and solids traveling downhole.

Looking at FIG. 5, when pump 18 is off, either intentionally or otherwise the column of wellbore fluid within production tubular 24 moves in a direction downhole under the force of gravity. Wellbore fluid flowing downhole will pass motor 20, and protector assembly 22. As discussed herein in further detail, solids and fluids cannot enter solids isolator 32. Wellbore fluid and solids will remain within annular space 49 and continue to travel in a downhole direction towards upward facing surface 51 of production tubular 24. The fluid and solids can then enter sand diverter 40 to be directed downhole of downhole packer 28.

Figure 6:
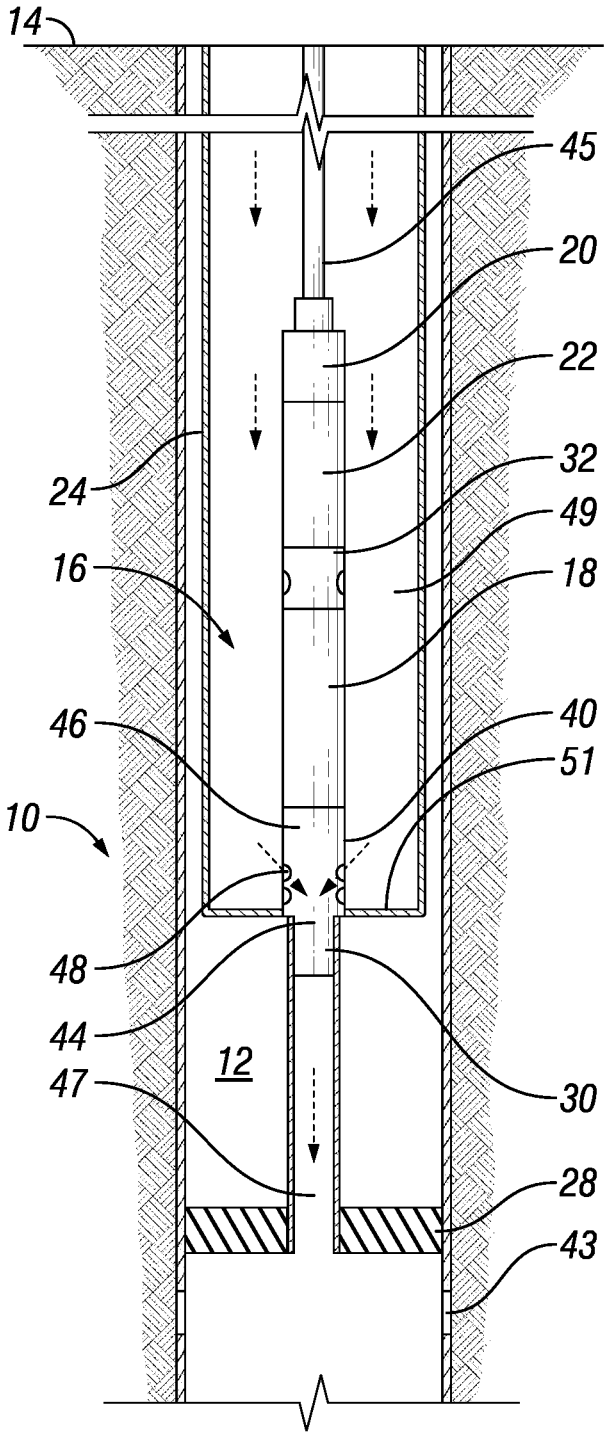
FIG. 6 is a section view of a subterranean well with an electric submersible pump system and a solids isolator in accordance with an embodiment of this disclosure, shown with a pump of the electric submersible pump system off and fluids being delivered from the surface to downhole of the electric submersible pump system.

In the embodiment of FIG. 6, there may be times when an operator delivers fluids from surface 14 to downhole of downhole packer 28. As an example, an operator may desire to deliver higher density liquids to the formation downhole of downhole packer by way of perforations 43 in a bullheading operation. Fluids delivered as part of a bullheading operation may have suspended particles as part of the mixture component, which may be detrimental to the electrical submersible pump system. The bullheading operation may involve, for example, pumping liquid chemicals, such as acids, into the formation as a treatment to clean up the well of scales, or solids cake, or as a treatment of the reservoir to enhance stimulation and increase production. As shown in FIG. 6, the fluids delivered downhole will pass outside of motor 20, and protector assembly 22.

As discussed herein in further detail, with the pump off, solids and fluids cannot enter solids isolator 32 and will remain within annular space 49 and continue to travel in a downhole direction, and enter sand diverter 40 to be directed downhole of downhole packer 28. The bullheaded liquids will therefore bypass the inverted electric submersible pump system, thereby protecting the electric submersible pump system.

The risk of sand and other solids falling back through electric submersible pump system when pump 18 is shut down increases with increasing sand or solids concentration in the wellbore fluids. Sand falling back downhole through pump 18 can cause damage to the stages of pump 18, cause blockages in pump 18, or can result in broken shafts when restarting pump 18. In addition, during bullheading operations, allowing liquids used during the bullheading operations to pass through the pump can be detrimental to certain components electric submersible pump system, which increases the susceptibility of the electric submersible pump system to premature failure.

Figure 7:
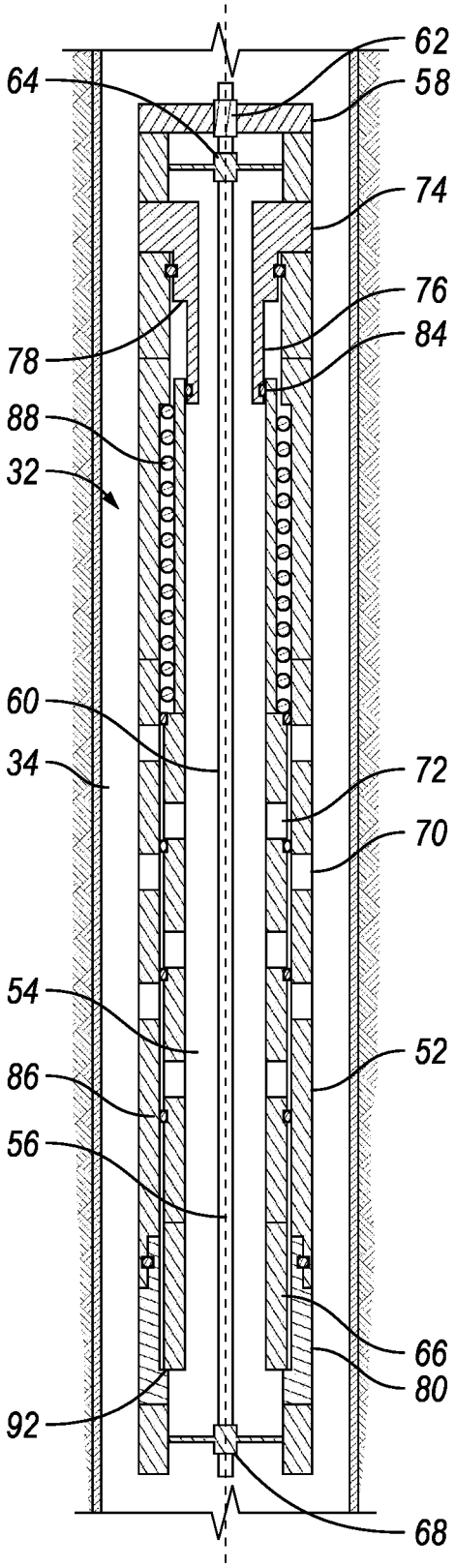
FIG. 7 is a section view of a solids isolator in accordance with an embodiment of this disclosure, shown with the sliding seal member in the port closed position.

Looking at FIG. 7, an embodiment of solids isolator 32 is shown. Solids isolator 32 includes tubular discharge body 52. Discharge body 52 is static relative to pump 18 and protector assembly 22. Discharge body 52 has inner discharge bore 54 centered along central axis 56. An uphole end of solids isolator 32 has end cap 58. End cap 58 seals across discharge bore 54, preventing fluids from within discharge bore 54 from traveling uphole past end cap 58 within the components of electric submersible pump system.

End cap 58 circumscribes shaft 60. Shaft 60 extends between motor 20 and pump 18, along central axis 56. Shaft 60 transmits rotation from motor 20 to drive pump 18. Uphole rotary seal 62 seals between shaft 60 and a central opening of end cap 58 through which shaft 60 passes. Uphole bearing 64 supports shaft 60 within discharge bore 54 of discharge body 52. Uphole bearing 64 is located uphole of sliding seal member 66.

A downhole end of solids isolator 32 is open. Fluid and solids can travel freely through downhole end of solids isolator 32 between discharge bore 54 and an interior of pump 18. Downhole bearing 68 supports shaft 60 within discharge bore 54 of discharge body 52. Downhole bearing 68 is located downhole of sliding seal member 66.

Body port 70 extends through a sidewall of discharge body 52. In the example embodiment of FIG. 7, there are a plurality of individual body ports 70 spaced around a circumference of discharge body 52. In alternate embodiments there can be a single body port 70.

Sliding seal member 66 is located within discharge bore 54. Sliding seal member 66 is ring shaped in cross section. Sliding seal member 66 is moveable between a port open position (FIGS. 8 and 12) and a port closed position (FIGS. 7, 9-10, and 13). Sliding seal member 66 moved axially between the port open position and the port closed position.

When sliding seal member 66 is in the port open position, body port 70 is open or unblocked and fluids can travel through body port 70 between discharge bore 54 and an outside of the electric submersible pump system. When sliding seal member 66 is the port closed position, body port 70 is closed or blocked so that fluids are prevented from traveling through body port 70 between discharge bore 54 and the outside of the electric submersible pump system.

Figure 8:
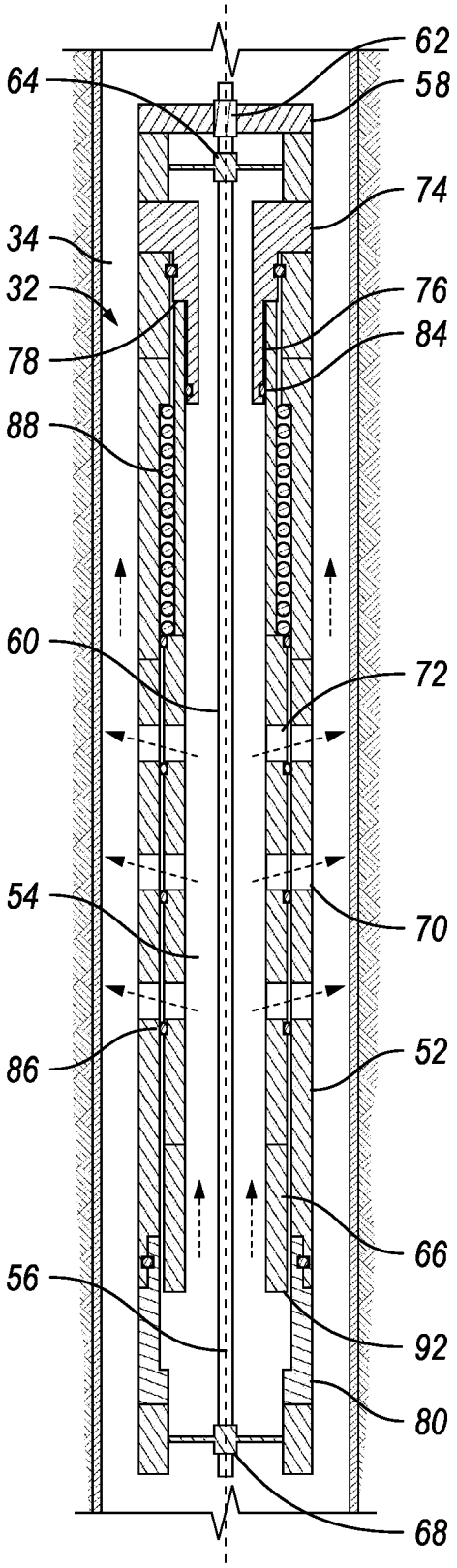
FIG. 8 is a section view of a solids isolator in accordance with an embodiment of this disclosure, shown with the sliding seal member in the port open position and fluids traveling in an uphole direction.

In the example embodiment of FIG. 8, when sliding seal member 66 is in the port open position, fluids and solids can travel from downhole of sliding seal member 66 through body port 70 and into annular space 34. In alternate embodiments, fluids and solids can travel from downhole of sliding seal member 66 through body port 70 and into annular space 49.

In the example embodiment of FIG. 8, sliding seal member 66 includes inner port 72. Inner port 72 extends through a sidewall of sliding seal member 66. Sliding seal member 66 can have a number and pattern of individual inner ports 72 that correspond to the number and pattern of individual body ports 70. In alternate embodiments, there can be a single inner port 72. As shown in the embodiment of FIG. 8, when sliding seal member 66 is in the port open position, body ports 70 are aligned with inner ports 72.

Figure 9:
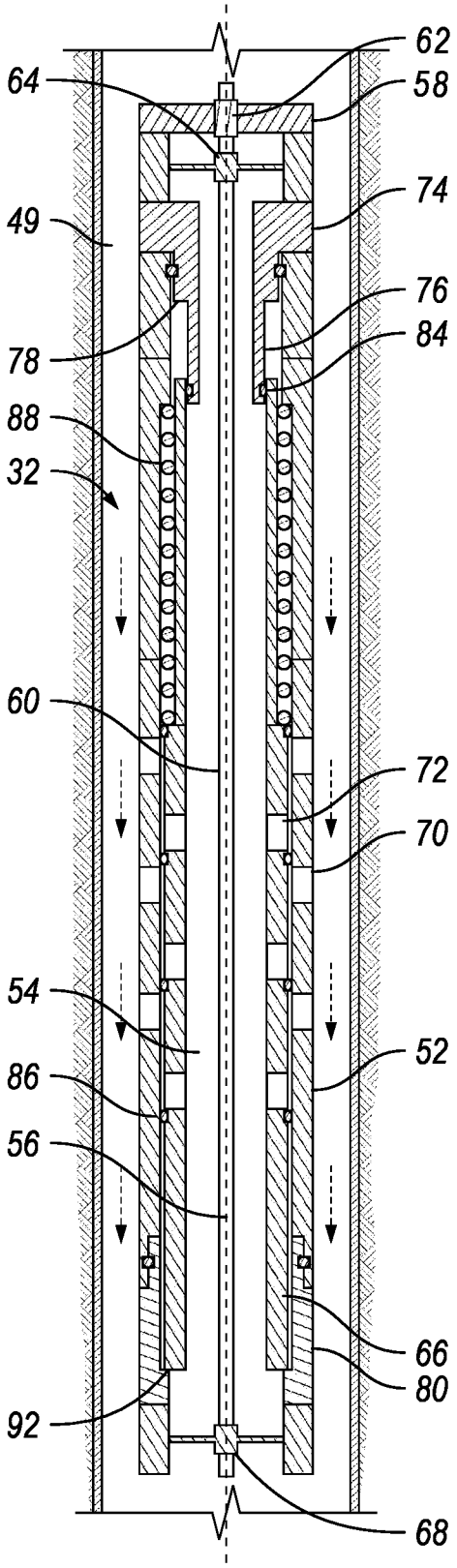
FIG. 9 is a section view of a solids isolator in accordance with an embodiment of this disclosure, shown with the sliding seal member in the port closed position and fluids traveling in a downhole direction.

When sliding seal member 66 is in the port closed position, as shown in the embodiment of FIGS. 7 and 9, body ports 70 are misaligned. In such embodiments, fluids and solids are blocked from traveling between discharge bore 54 and annular space 34 or annular space 49, as applicable, through body port 70.

In the embodiments of FIGS. 10-13, sliding seal member 66 is a traveling ring. The traveling ring is located downhole of body port 70 when sliding seal member 66 is in the port closed position of FIGS. 10 and 13. The traveling ring is located uphole of body port 70 when sliding seal member 66 is in the port open position of FIG. 12.

Solids isolator 32 further includes housing head 74. Housing head 74 is positioned uphole of discharge body 52 and can be secured to discharge body 52. Housing head 74 is static relative to discharge body 52, pump 18, and protector assembly 22. Housing head 74 includes tubular lip 76. Tubular lip 76 extends axially within discharge bore 54.

In the embodiment of FIGS. 7-9, housing head 74 further includes head shoulder 78. Head shoulder 78 has a circumferential surface that faces downhole. Head shoulder 78 is positioned to limit uphole movement of sliding seal member 66 relative to discharge body 52. Looking at FIG. 8, when an uphole end of sliding seal member 66 contacts head shoulder 78, sliding seal member 66 is in the port open position.

Solids isolator 32 further includes base member 80. Base member 80 is positioned downhole of discharge body 52 and can be secured to discharge body 52. Base member 80 can include base shoulder 82. Base shoulder 82 has a circumferential surface that faces uphole and is positioned to limit downhole movement of sliding seal member 66 relative to discharge body 52. Looking at FIGS. 7 and 9, when a downhole end of sliding seal member 66 contacts base shoulder 82, sliding seal member 66 is in the port closed position.

Solids isolator 32 includes a series of seals. The seals prevent migration of well fluid between components of solids isolator 32. The seals are gas tight to provide sealing properties in wells with relatively high gas-oil ratios and in high pressure fluid developments. The seals can be o-rings.

Inner seal 84 seals between an outer diameter surface of tubular lip 76 of housing head 74 and an inner diameter surface of sliding seal member 66. In the example embodiments of FIGS. 7-9, inner seal 84 is positioned on tubular lip 76 and in the example embodiments of FIGS. 10-13, inner seal 84 is positioned on sliding seal member 66.

Outer seal 86 seals between an outer diameter surface of sliding seal member 66 and an inner diameter surface of discharge bore 54. In each of the example embodiments of FIGS. 7-13 outer seal 86 is located within sliding seal member 66. In alternate embodiments, outer seal can be located within a sidewall of discharge body 52.

In the embodiments of FIGS. 7-9, one of the outer seals 86 is located uphole of an uphole-most row of inner port 72. One of the outer seals 86 is located downhole of a downhole-most row of inner ports 72. Outer seals 86 can also be located uphole and downhole of each adjacent row of inner ports 72. Such outer seals 86 prevent migration of wellbore fluid through the clearance between the outer surface of sliding seal member 66 and the inner surface of discharge body 52.

Biasing member 88 is positioned to bias sliding seal member 66 towards the port closed position. Biasing member 88 can be a spring. Biasing member 88 can be under compression between sliding seal member 66 and a static member of solids isolator 32. In the embodiments of FIGS. 7-9, biasing member 88 is positioned between sliding seal member 66 and discharge body 52. In the embodiments of FIGS. 10-13, biasing member 88 is positioned between sliding seal member 66 and housing head 74.

As shown in FIGS. 7, 9-10, and 13, sliding seal member 66 is biased to the port closed position by biasing member 88 when pump 18 is off. In alternate embodiments, biasing member 88 can be located in alternate locations within solids isolator 32 that allows sliding seal member 66 to be biased towards the closed position.

The spring stiffness and contraction length of biasing member 88 are selected to match the required spring force needed for the solids isolator 32 to function effectively based on downhole pressures that solids isolator 32 will be exposed to. The downhole pressures will be based on the final setting depth of solids isolator 32 and the properties of the wellbore fluids.

Biasing member 88 can be made of high performance alloy material, such as a nickel-chromium alloy, a nickel-chromium-molybdenum alloy, Hastelloy®, or other material that is resistance to attack of certain wellbore corrosive fluids. The material forming biasing member 88 can also be anti-scale sticking or adhering, erosion resistant, and abrasion resistant. The material forming biasing member 88 should also have excellent structural and cyclic loading properties to withstand the potential cycling that biasing member 88 will experience during operation of solids isolator 32 downhole.

In the embodiments of FIGS. 7-9, biasing member 88 is located within a spring cavity between sliding seal member 66 and discharge body 52. The cavity, where biasing member 88 is located can be partially filled with grease or oil. The grease or oil ensures lubrication of biasing member 88. The volume of grease or oil will be less than the minimum volume of the chamber, which occurs when sliding seal member 66 is at its highest point, as shown in FIG. 8. Maintaining this volume of grease or oil will prevent any excessive pressure buildup within the cavity when the sliding seal member 66 moves to the port open position.

Figure 10:
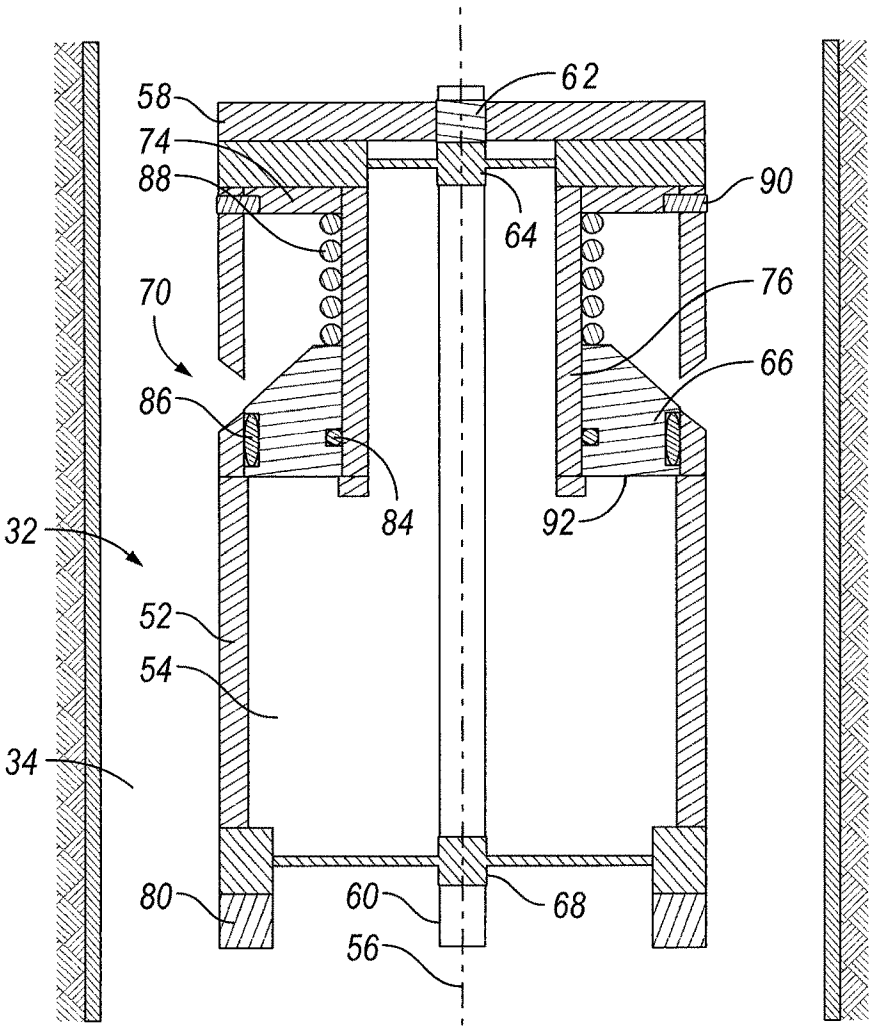
FIG. 10 is a section view of a solids isolator in accordance with an embodiment of this disclosure, shown with the sliding seal member in the port closed position.
Figure 13:
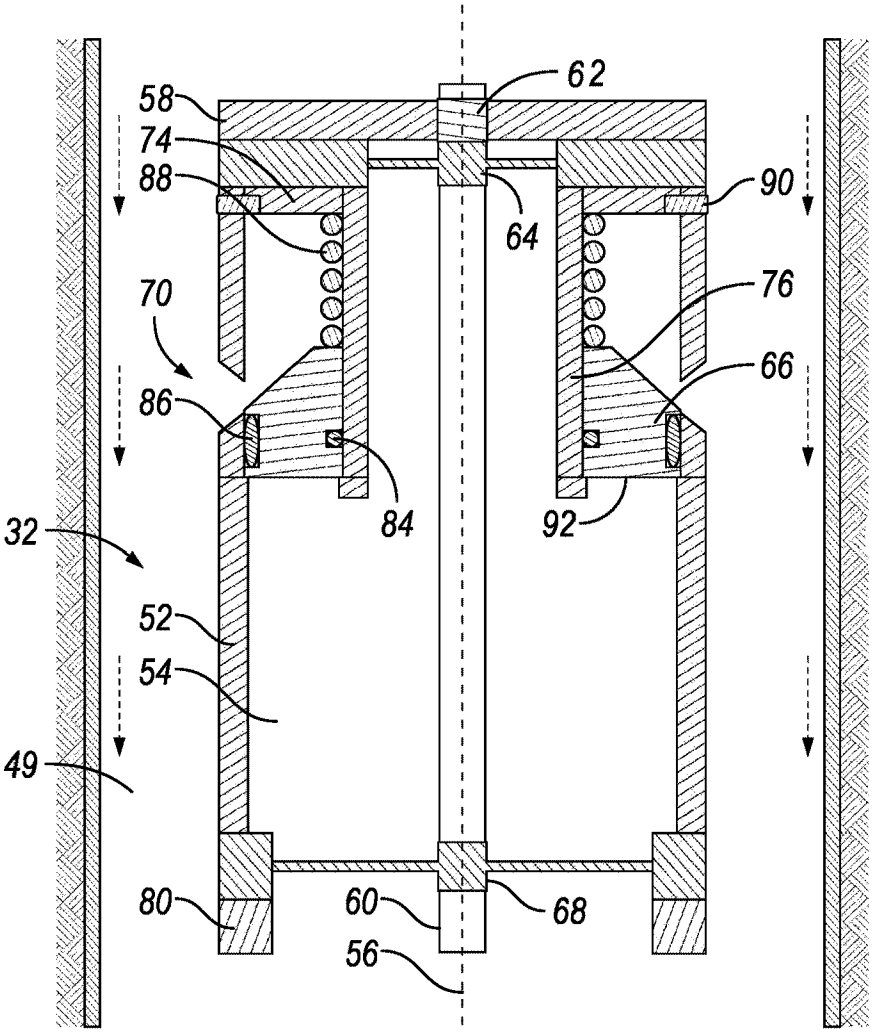
FIG. 13 is a section view of a solids isolator in accordance with an embodiment of this disclosure, shown with the sliding seal member in the port closed position and fluids traveling in a downhole direction.

In the embodiments of FIGS. 10-13, biasing member 88 is located in a spring cavity that is filled with wellbore fluids. Biasing member 88 can bias the traveling cone so that when sliding seal member 66 is in the port closed position, the traveling cone rests on a shoulder of tubular lip 76, a shoulder of discharge body 52, or on a shoulder of both tubular lip 76 and discharge body 52, as shown in FIGS. 10 and 13.

Figure 11:
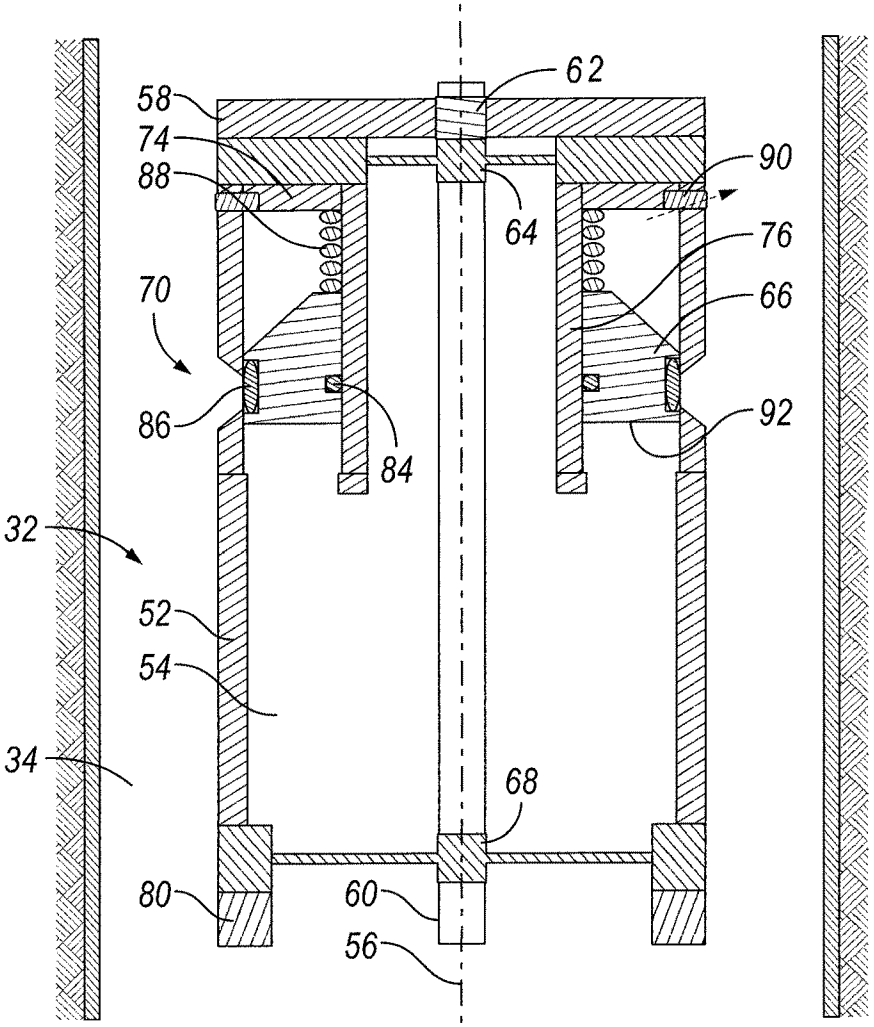
FIG. 11 is a section view of a solids isolator in accordance with an embodiment of this disclosure, shown with the sliding seal member moving from the port closed position to the port open position.

As shown in the embodiments of FIG. 11, as sliding seal member 66 moves from the port closed position to the port open position, fluid trapped within the spring cavity can exit the spring cavity through check valve 90. Check valve 90 is oriented to allow fluids to travel from discharge bore 54 to the outside of the electric submersible pump system. This ensures there is no pressure buildup within the spring cavity.

Check valve 90 prevents fluids from traveling from the outside of the electric submersible pump system to inside discharge bore 54. Check valve 90 is located uphole of the traveling ring of sliding seal member 66 and extends through a sidewall of discharge body 52. Although two check valves 90 are shown, one check valve 90 or more than two check valves 90 can be included.

Sliding seal member 66 further includes counter pressure member 92. Counter pressure member 92 is a downhole facing surface of sliding seal member 66. Counter pressure member 92 is oriented so that when pump 18 is on, a fluid force on counter pressure member 92 overrides a force of biasing member 88, moving sliding seal member 66 towards the port open position.

Looking at FIGS. 7 and 10, when solids isolator 32 is located at the surface, before deployment downhole, sliding seal member 66 is biased to a port closed position. This port closed position is maintained by biasing member 88 as solids isolator 32 is made up as part of submersible pump string 16 and lowered into wellbore 12 to the setting depth. As pump string 16 is lowered into wellbore 12, downhole pressure can exert a force on counter pressure member 92. Solids isolator 32 will be exposed to a hydrostatic pressure, which increases with depth. However biasing member 88 is selected so that the force of biasing member 88 is not overcome by such hydrostatic pressures while pump 18 remains off.

As additional fluid pressure is applied in an uphole direction on pressure member 92, such as when pump 18 is on, sliding seal member 66 will move from the port closed position to the port open position, as shown in FIG. 11. In the configuration of FIG. 11, body ports 70 are still isolated to prevent entry of the high pressure fluid from downhole of sliding seal member 66 through body ports 70.

Figure 12:
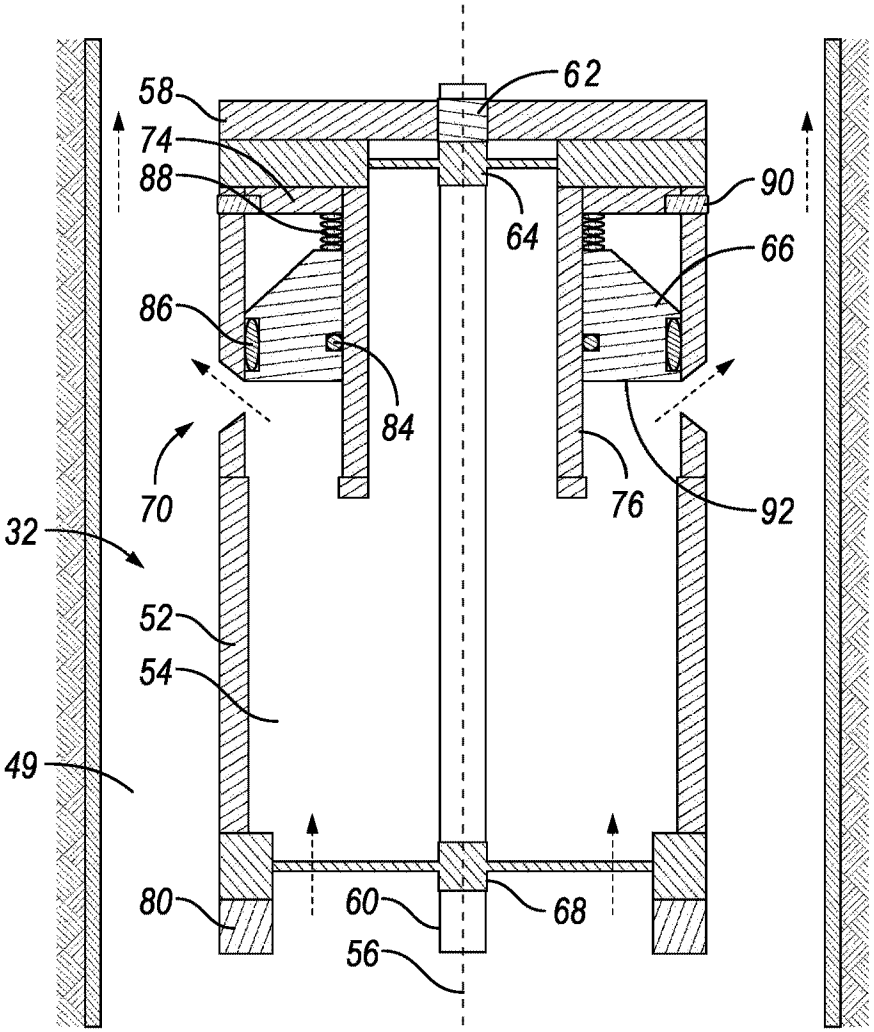
FIG. 12 is a section view of a solids isolator in accordance with an embodiment of this disclosure, shown with the sliding seal member in the port open position and fluids traveling in an uphole direction.

With pump 18 on and force applied to pressure member 92, sliding seal member 66 will continue to move in an uphole direction and biasing member 88 is further compressed until sliding seal member 66 is in the port open position of FIGS. 8 and 12. With sliding seal member 66 in the port open position, fluids that have traveled uphole through pump 18 can travel out of discharge bore 54 into annular space 34 or annular space 49, as applicable, through body port 70.

In the event pump 18 is turned off the flow of wellbore fluid is reduced and the sum of pressures acting on pressure member 92 decreases and becomes less than the force applied by biasing member 88. Sliding seal member 66 will then return to the port closed position of FIGS. 9 and 13. With the pump 18 turned off, the wellbore fluids and solids within submersible pump string 16 travel downhole under the force of gravity.

In an example of operation and looking at FIGS. 1 and 4, in order to provide artificial lift to wellbore fluids submersible pump string 16 can be set within wellbore 12. Submersible pump string 16 includes solids isolator 32. While pump 18 is running, wellbore fluid from within wellbore downhole of downhole packer 28 passes into stinger inner bore 44 of stinger 30 to pass by downhole packer 28.

With pump 18 on, sliding seal member 66 of solids isolator 32 is in the port open position. Solids isolator 32 can direct fluid and any solids out of pump 18 and into annular space 34 or annular space 49, as applicable and be directed into production tubular 24 for delivery to the surface.

When pump 18 is turned off, sliding seal member 66 of solids isolator 32 moves to the port closed position. Looking at FIGS. 2 and 5, fluids and solids will fall in a downhole direction under the force of gravity. Because sliding seal member 66 of solids isolator 32 is in the port closed position, any fluids and solids traveling downhole past solids isolator 32 cannot enter the electric submersible pump system through body port 72. The fluids and solids will instead pass through sand diverter 40 to travel downhole of downhole packer 28.

Looking at FIGS. 3 and 6, during a bullheading operation, fluids delivered downhole will pass outside of monitoring sub 38, motor 20, and protector assembly 22. Any fluids or solids cannot enter solids isolator 32 and will remain within annular space 34 and continue to travel in a downhole direction towards downhole packer 28 and enter sand diverter 40 to be directed downhole of downhole packer 28.

Embodiments described in this disclosure therefore prevent fall back of sand and other solids into the inverted electric submersible pump systems. Systems and methods also prevent back-spinning of the pump stages caused by liquid falling back through the pump. When the solids isolator is used in conjunction with a sand diverter for inverted electric submersible pump systems, the fallback sand and solids can pass through the sand diverter and down to the formation below. Furthermore, during a bullheading operation, any fluids delivered in the bullheading operation that could be harmful to internal components of the electric submersible pump systems bypass the electric submersible pump systems and flow to the formation below.

Embodiments of this disclosure, therefore, are well adapted to carry out the objects and attain the ends and advantages mentioned, as well as others that are inherent. While embodiments of the disclosure has been given for purposes of disclosure, numerous changes exist in the details of procedures for accomplishing the desired results. These and other similar modifications will readily suggest themselves to those skilled in the art, and are intended to be encompassed within the spirit of the present disclosure and the scope of the appended claims.

What is claimed is:

1. A system for providing artificial lift to wellbore fluids, the system having:

a pump located within a wellbore, the pump oriented to selectively boost a pressure of the wellbore fluids traveling from the wellbore towards an earth's surface through a production tubular;

a motor located within the wellbore uphole of the pump and providing power to the pump;

a protector assembly located between the pump and the motor, where the pump, the motor, and the protector assembly form an electric submersible pump system;

a downhole packer located within the wellbore downhole of the pump, the downhole packer sealing an annular space between an outer diameter surface of the electric submersible pump system and an inner diameter of the wellbore;

a solids isolator located between the pump and the protector assembly, the solids isolator including:

a tubular discharge body with an inner discharge bore having a central axis;

a body port that extends through a sidewall of the discharge body; and a sliding seal member located within the discharge bore, the sliding seal member moveable between a port open position where the body port is open to allow fluids to travel through the body port between the discharge bore and an outside of the electric submersible pump system, and a port closed position where fluids are prevented from traveling through the body port between the discharge bore and the outside of the electric submersible pump system; where the sliding seal member is ring shaped in cross section;

the sliding seal member is biased to the port closed position when the pump is off; and the sliding seal member is moveable to the port open position when the pump is on.

2. The system of claim 1, further including a biasing member, the biasing member positioned to bias the sliding seal member towards the port closed position.

3. The system of claim 2, where the sliding seal member further includes a counter pressure member, the counter pressure member oriented so that when the pump is on, a force on the counter pressure member overrides a force of the biasing member, moving the sliding seal member towards the port open position.

4. The system of claim 1, further including a sand diverter located downhole of the pump and having a flow port assembly located uphole of the downhole packer, the sand diverter having a diverter inner bore in fluid communication with the wellbore downhole of the downhole packer, where the flow port assembly has an inner sleeve that is moveable between an open position where an inner sleeve port assembly is aligned with an outer sleeve port assembly of an outer sleeve, and a closed position where the inner sleeve port assembly is misaligned with the outer sleeve port assembly.

5. The system of claim 1, where the tubular discharge body has a housing head that has a tubular lip that extends axially within the discharge bore, and where the solids isolator further includes:

an inner seal that seals between an outer diameter surface of the tubular lip of the housing head and an inner diameter surface of the sliding seal member; and an outer seal that seals between an outer diameter surface of the sliding seal member and an inner diameter surface of the discharge bore.

6. The system of claim 1, further including a shaft extending between the motor and the pump, the shaft extending along the central axis of the discharge body, where the solids isolator further includes:

a downhole bearing supporting the shaft within the discharge bore of the discharge body downhole of the sliding seal member; and an uphole bearing supporting the shaft within the discharge bore of the discharge body uphole of the sliding seal member.

7. The system of claim 6, where the discharge body includes:

an uphole end that has an end cap, the end cap circumscribing the shaft and sealing across the discharge bore; and an uphole rotary seal that seals between the shaft and a central opening of the end cap; where the discharge body has a downhole end that is open.

8. The system of claim 1, where:

the discharge body includes a plurality of the body ports;

the sliding seal member includes a plurality of inner ports; and when the sliding seal member is in the port open position, the body ports are aligned with the inner ports.

9. The system of claim 1, where the sliding seal member includes a traveling ring, the traveling ring located downhole of the body port when the sliding seal member is in the port closed position, and the traveling ring is located uphole of the body port when the sliding seal member is in the port open position.

10. The system of claim 9, where the solids isolator further includes a check valve, the check valve oriented to allow fluids to travel from the discharge bore to the outside of the electric submersible pump system, and to prevent fluids from traveling from the outside of the electric submersible pump system to inside the discharge bore, the check valve located uphole of the traveling ring.

11. A method for providing artificial lift to wellbore fluids, the method including:

locating a pump within a wellbore, the pump operable to selectively boost a pressure of the wellbore fluids traveling from the wellbore towards an earth's surface through a production tubular;

locating a motor within the wellbore uphole of the pump, the motor providing power to the pump;

locating a protector assembly between the pump and the motor, where the pump, the motor, and the protector assembly form an electric submersible pump system;

locating a downhole packer within the wellbore downhole of the pump, the downhole packer sealing an annular space between an outer diameter surface of the electric submersible pump system and an inner diameter of the wellbore;

locating a solids isolator between the pump and the protector assembly, the solids isolator including:

a tubular discharge body with an inner discharge bore having a central axis;

a body port that extends through a sidewall of the discharge body; and a sliding seal member located within the discharge bore, the sliding seal member moveable between a port open position where the body port is open to allow fluids to travel through the body port between the discharge bore and an outside of the electric submersible pump system, and a port closed position where fluids are prevented from traveling through the body port between the discharge bore and the outside of the electric submersible pump system; where the sliding seal member is ring shaped in cross section;

the sliding seal member moves to the port closed position when the pump is off; and the sliding seal member moves to the port open position when the pump is on.

12. The method of claim 11, further including a biasing member, the biasing member positioned to bias the sliding seal member towards the port closed position.

13. The method of claim 12, where the sliding seal member further includes a counter pressure member, where the method further includes moving the sliding seal member towards the port open position when the pump is on with a fluid force applied to the counter pressure member that overrides the force of the biasing member.

14. The method of claim 11, further including a sand diverter located downhole of the pump and having a flow port assembly located uphole of the downhole packer, the sand diverter having a diverter inner bore in fluid communication with the wellbore downhole of the downhole packer, where the method further includes moving an inner sleeve of the flow port assembly between an open position where an inner sleeve port assembly is aligned with an outer sleeve port assembly of an outer sleeve, and a closed position where the inner sleeve port assembly is misaligned with the outer sleeve port assembly.

15. The method of claim 11, where the tubular discharge body has a housing head that has a tubular lip that extends axially within the discharge bore, and where the method further includes:

sealing between an outer diameter surface of the tubular lip of the housing head and an inner diameter surface of the sliding seal member with an inner seal; and sealing between an outer diameter surface of the sliding seal member and an inner diameter surface of the discharge bore with an outer seal.

16. The method of claim 11, further including a shaft extending between the motor and the pump, the shaft extending along the central axis of the discharge body, where the method further includes:

supporting the shaft within the discharge bore of the discharge body downhole of the sliding seal member with a downhole bearing; and supporting the shaft within the discharge bore of the discharge body uphole of the sliding seal member with an uphole bearing.

17. The method of claim 16, where the discharge body includes:

an uphole end that has an end cap, the end cap circumscribing the shaft and sealing across the discharge bore; and an uphole rotary seal that seals between the shaft and a central opening of the end cap; where the discharge body has a downhole end that is open.

18. The method of claim 11, where the discharge body includes a plurality of the body ports and the sliding seal member includes a plurality of inner ports, and where the method further includes aligning the inner ports with the body ports when the sliding seal member is in the port open position.

19. The method of claim 11, where the sliding seal member includes a traveling ring, the method further includes positioning the traveling ring downhole of the body port when the sliding seal member is in the port closed position, and positioning the traveling ring uphole of the body port when the sliding seal member is in the port open position.

20. The method of claim 19, further including locating a check valve uphole of the traveling ring, the check valve oriented to allow fluids to travel from the discharge bore to the outside of the electric submersible pump system, and to prevent fluids from traveling from the outside of the electric submersible pump system to inside the discharge bore.

* * * * *